United States Patent [19]

Ulrich et al.

[11] 4,079,577

[45] Mar. 21, 1978

[54] APPARATUS FOR SEALING CONTAINERS

[75] Inventors: Lawrence Walter Ulrich; Connie Wayne Walker, both of Bolingbrook, Ill.

[73] Assignee: Durable Packaging Corporation, Chicago, Ill.

[21] Appl. No.: 808,990

[22] Filed: Jun. 21, 1977

[51] Int. Cl.[2] ..... B65B 7/20
[52] U.S. Cl. ..... 53/374
[58] Field of Search ..... 53/374

[56] References Cited

U.S. PATENT DOCUMENTS 3,821,875 7/1974 Paxton ..... 53/374

FOREIGN PATENT DOCUMENTS 644,370 2/1964 France ..... 374/

*Primary Examiner*—Travis S. McGehee
*Attorney, Agent, or Firm*—Lawrence Walter Ulrich; Connie Wayne Walker

[57] ABSTRACT

An apparatus for automatically sealing random sized cartons which includes a mechanism for automatically infolding the top flaps prior to the application of the adhesive material.

8 Claims, 3 Drawing Figures

APPARATUS FOR SEALING CONTAINERS

BACKGROUND AND SUMMARY OF THE INVENTION

The present invention relates to apparatus for sealing the foldable flaps of cartons of random sizes by applying a self-adhesive tape material along the edges of the flaps, and more particularly to an improved mechanism for automatically infolding the top flaps prior to the application of the adhesive material.

In the packaging industry, corrugated and fiberboard cartons have been used for many years and various machines have been developed which are capable of sealing such cartons either by gluing the flaps, taping the flaps, or by stapling or otherwise providing mechanical fasteners to maintain the flaps in a closed position. Many of these machines are designed to accept cartons of random width and height by providing various types of sensing means to control the transverse movement of the side arms associated therewith and the vertical movement of the top sealing means. An example of such a machine is disclosed in U.S. patent application Ser. No. 700,170, filed on June 28, 1976, and having the same inventive entity as the present invention.

The present invention is directed to a mechanism for automatically infolding the top flaps of the carton for use with carton sealing machines which include transversely moving side arms and vertically moving top sealing means. Prior to the present invention, many devices have been known for infolding the top flaps of cartons subsequent to the application of the sealing means. These devices have included intricate mechanical and pneumatic mechanisms which require critical adjustments for proper operation.

Briefly stated, the mechanism for infolding the top flaps in accordance with the present invention includes a first flap folding means secured to and movable with the sealing head. The first flap folding means is effective to infold the leading and trailing end flaps. A second flap folding means is provided which is transversely movable with each of the side arm means and vertically movable with the head sealing means. The second flap folding means is effective to infold the side flaps.

DESCRIPTION OF A PREFERRED EMBODIMENT

Figures 1, 2, 3:
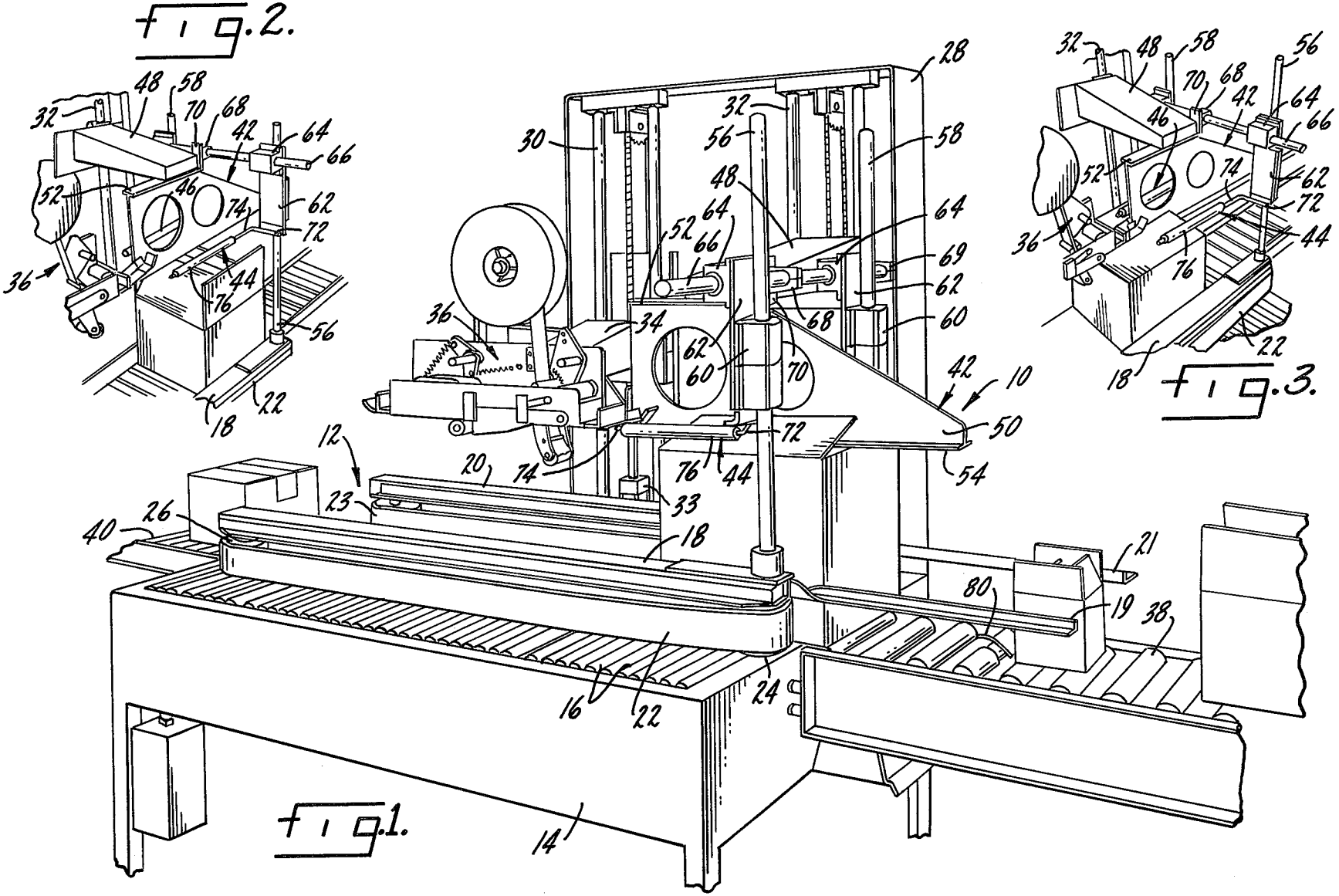
FIG. 1 is a perspective view of a carton sealing apparatus including the flap folding mechanism constructed in accordance with the present invention.
FIG. 2 is a perspective view of the flap folding mechanism showing a carton with its flaps in position immediately prior to their being infolded.
FIG. 3 is a perspective view of the flap folding mechanism showing a carton with its flaps infolded.

Referring now in detail to the drawing and in particular to FIG. 1, the flap folding mechanism 10 constructed in accordance with the present invention is illustrated in combination with a carton sealing apparatus 12 of the type disclosed in U.S. patent application Ser. No. 700,170, having a common inventive entity and assignee to the present invention. In order to keep the construction details of the carton sealing apparatus to a minimum, the disclosure of U.S. patent application Ser. No. 700,170 is hereby incorporated by reference for such disclosure.

Carton sealing apparatus 12 includes a frame structure 14 for support of a plurality of longitudinally spaced carton conveying rollers 16. A pair of transversely spaced and longitudinally extending side arm assemblies 18 and 20 are mounted to frame 14 above rollers 16. The side arm assemblies 18 and 20 are mounted so as to permit simultaneous transverse sliding movement towards and away from each other. Carton centering extensions 19 and 21 are secured to the respective side arms 18 and 20. Endless conveyer belts 22 and 23 are journaled around rollers 24 and 26. Extending vertically upward from frame 10 is a structural vertical lift housing 28. Positioned within housing 28 are a pair of vertical lift assemblies 30 and 32 which are powered by a single pneumatic cylinder 33. Lift assembly 30 is secured to tape head support assembly 34 and is effective to move the tape head assembly 36, associated therewith, up and down above the center longitudinal axis of frame 10. Lift assembly 30 is secured to flap folding mechanism 10. Lift assemblies 30 and 32 move up and down together along with the tape head support assembly 34 and the flap folding mechanism 10 respectively associated therewith. Support assembly 34 and folding mechanism 10 are rigidly secured to one another to effect such simultaneous movement. A powered infeed conveyor 38 is provided to feed cartons onto sealing apparatus 12 and a powered outfeed conveyor 40 is provided to remove sealed cartons from sealing apparatus 12.

As alluded to hereinabove, the present invention is specifically directed to an improved mechanism for automatically infolding the flaps of an incoming carton immediately prior to the application of the sealing means. Flap folding mechanism 10, constructed in accordance with the invention, includes a head plough member 42 for infolding the leading top flap and the trailing top flap and a pair of flap contacting arms 44 and 46 for infolding the respective side flaps. Extending transversely inward from lift assembly 30, and vertically movable therewith, is a support assembly 48. Head plough member 42 is rigidly secured along its upper edge to the underside of support assembly 48, and extends downwardly therefrom, and at its lower edge to tape head assembly 36. Plough 42 includes a longitudinally extending plate portion 50 oriented in a vertical plane passing through the longitudinal center axis of apparatus 12. The upper edge of plough 42 terminates in a flat horizontal portion 52 which is secured to support assembly 48. The lower edge of plough 42 terminates in a flat horizontal portion 54 which, as will hereinbelow be further discussed, contacts and infolds the leading and trailing top flaps.

Guide rods 56 and 58 extend respectively vertically upward from the upper forward surfaces of side arms 18 and 20. Mounted about each of the guide rods 56 and 58 is a bearing assembly 60 in a manner which permits same to move vertically up and down the respective rods. A connecting plate 62, having a bearing 64 associated therewith, is secured to each bearing assembly 60. A connecting rod 66 extends transversely through the respective bearings 64 so as to effect unison vertical movement of the bearing assemblies 60 to permit transverse movement of bearings 64. Connecting rod 66 is rigidly secured at an intermediate point to support assembly 48 through a clamp 68 and a connecting plate 70 and to housing 28 at clamp 69. Flap contacting arms 44 and 46 are secured to a respective bearing assembly 60. Contacting arms 44 and 46 include a transverse portion 72 which is secured to the bearing assembly and a longitudinal portion 74 which is bent to extend inwardly of the respective side arms 18 and 20. Portion 74 preferably extends slightly inwardly in the direction of movement of the carton to be sealed. Journaled for rotation about each longitudinal portion 74 is a roller member 76.

From the foregoing description of flap closing mechanism 10, it should be readily apparent that the vertical movement of support assembly 48 is effective to move plough member 42 and arms 44 and 46 up and down therewith. Further, the transverse movement of side arms 18 and 20 is effective to move contacting arms 44 and 46 inward and outward therewith.

To control the sequential movement of the side arm assemblies 18 and 20 and the vertical lift assemblies 30 and 32, a pair of pneumatic switches 80 and 82 (not shown) are provided to sense the relative position of the carton as it enters and proceeds through the apparatus 12. Pneumatic switch 80 is positioned on infeed conveyor 38 below the centering extensions 19 and 21. Pneumatic switch 80 is operative to contact the leading edge of the carton and activate the inward movement of the side arms 18 and 20 such that extensions 19 and 21 contact the sides of the carton and longitudinally center it on conveyor 38. Switch 80 has a time delay built therein, such that after a very short period of time the side arms 18 and 20 automatically return to their outermost position. Pneumatic switch 82 (not shown) is secured to frame 14 immediately below plough 50 adjacent rollers 16. Pneumatic switch 82 is operative to contact the leading edge of the carton and cause lift sections 30 and 32 to move downward until plough 50 contacts the upper edges of the carton. Switch 82 has a first built-in time delay equal to the time it takes the plough 50 to contact the lowest carton the unit is designed to handle. After this first time delay has lapsed, the switch 82 is operative to activate the inward movement of the side arms 18 and 20 into contact with the sides of the carton. Switch 82 has a second built-in time delay which is activated by the trailing edge of the carton so as to retain the tape head assembly in its down position and the side arms in contact with the carton for the predetermined period of time necessary to deliver the carton to the outfeed conveyor 40. The specific pneumatic system and switching system required to function in the manner hereinabove described is of conventional design and not an integral part of the present invention, and consequently a detailed description thereof is not deemed necessary.

The modus operandi of the apparatus 12 in accordance with the invention will now be described with reference to the drawings as described above.

At the start of operation, side arms 18 and 20 are at their outermost positions and lift assemblies 30 and 32 are in their uppermost positions. As the carton to be sealed moves along conveyor 38, its leading edge contacts and activates switch 80. The activation of switch 80 causes side arms 18 and 20, and the extensions 19 and 21 associated therewith, to move inward such that the extensions 19 and 21 contact and center the carton on conveyor 38. After a short time delay, the side arms 18 and 20 return to their outermost position. The carton continues its inward movement on conveyor 38 and is fed onto rollers 16 of apparatus 12.

The leading edge of the carton contacts and activates switch 82 which initiates the downward movement of lift sections 30 and 32. As the lift sections move downward, the lower edge 54 of plough 50 contacts and infolds the end flaps of the carton. The lift sections continue downward until the lower edge 54 contacts the upper edges of the end walls of the carton. After a short time delay, the side arms 18 and 20 move inward into contact with the side wall of the carton. As the side arms move inward, the contacting arms 44 and 46, and rollers 76 associated therewith, contact and infold the side flaps of the carton as they continue to move inward. As can be best seen in FIG. 1, edge 52 remains in contact with the end flaps as the side flaps are folded thereover by the inward movement of the arms 44 and 46.

The conveyor belts 22 and 23 of the side arms 18 and 20 remain in contact with the sides of the carton and move it past the tape head assembly 36 where a strip of sealing tape is applied across the top surfaces of the side flaps and the upper portions of the end side walls. As the trailing edge of the carton passes over the switch 82, the second time delay is activated and a short time thereafter the lift assemblies 30 and 32 are returned to their uppermost position and the side arms 18 and 20 to their outermost position. The second time delay is of sufficient length to permit the sealed carton to be delivered to conveyor 40. The side arms 18 and 20 are returned to their outermost positions and the lift assemblies 30 and 32 to their uppermost positions.

The foregoing is a description of a preferred embodiment of the invention which is given here by way of example. The invention is not to be taken as limited to any of these specific features as described, but comprehends all such variations thereof as come within the scope of the appended claims.

What is claimed is:

1. In combination with apparatus of the type used for sealing the foldable flaps of cartons of random sizes, said apparatus including a frame structure, a vertically movable sealing head means mounted to said frame structure, and a pair of facing longitudinally extending side arm means mounted to said frame structure so as to permit transverse movement of said side arm means towards and away from each other; an improved mechanism for infolding the top flaps, comprising:

(a) a first flap folding means secured to said sealing head means and vertically movable therewith for infolding the leading top flap and the trailing top flap; and (b) a second flap folding means associated with and transversely movable with each of said side arm means and simultaneously vertically movable with said head sealing means for infolding the adjacent side flaps.

2. The invention as defined in claim 1 wherein said first flap folding means includes a plough member which descends with said sealing head means so as to simultaneously infold the leading top flap and the trailing top flap.

3. The invention as defined in claim 2 wherein each of said second flap folding means includes a substantially longitudinally extending contacting arms secured to and extending above and inwardly of each respective side arm means so as to infold the adjacent side flap as the side arm means moves into contact with the carton.

4. The invention as defined in claim 3 wherein said plough means infolds the leading and the trailing top flaps prior to said contacting arms, contacting and infolding the side flaps.

5. The invention as defined in claim 3 wherein each of said contacting arms are slidably mounted to a guide rod extending vertically upward from each of said side arm means.

6. The invention as defined in claim 5 wherein each of said contacting arms is secured to a first bearing member which in turn is slidably mounted to a corresponding guide rod.

7. The invention as defined in claim 6 wherein a transversely extending connecting rod extends between and is secured to said guide rods in a manner which permits inward and outward transverse movement of said guide rods.

8. The invention as defined in claim 7 wherein each of said first bearing members is rigidly secured to a second bearing member which in turn is slidably received about said connecting rod so as to effect unison vertical and transverse movement of said contacting arms.

* * * * *